US009488030B2

(12) United States Patent
Wood et al.

(10) Patent No.: US 9,488,030 B2
(45) Date of Patent: Nov. 8, 2016

(54) CONFINED VOLUME PRESSURE COMPENSATION DUE TO THERMAL LOADING

(71) Applicant: Baker Hughes Incorporated, Houston, TX (US)

(72) Inventors: Edward T. Wood, Kingwood, TX (US); David P. Gerrard, Montgomery, TX (US); Joshua C. Falkner, Richmond, TX (US); Ramon R. Garza, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 503 days.

(21) Appl. No.: 14/063,084

(22) Filed: Oct. 25, 2013

(65) Prior Publication Data

US 2015/0114621 A1 Apr. 30, 2015

(51) Int. Cl.

| | |
|---|---|
| ***E21B 33/124*** | (2006.01) |
| ***E21B 41/00*** | (2006.01) |
| ***E21B 33/00*** | (2006.01) |
| *E21B 34/06* | (2006.01) |

(52) U.S. Cl.

CPC ..... *E21B 33/124* (2013.01); *E21B 33/00* (2013.01); *E21B 41/00* (2013.01); *E21B 34/06* (2013.01)

(58) Field of Classification Search

CPC ..... E21B 33/124; E21B 34/06; E21B 41/00
See application file for complete search history.

(56) References Cited

U.S. PATENT DOCUMENTS

| | | | | |
|---|---|---|---|---|
| 5,549,162 | A * | 8/1996 | Moody | E21B 49/10 166/100 |
| 6,164,378 | A | 12/2000 | Coronado | |
| 7,246,664 | B2 * | 7/2007 | Shammai | E21B 49/10 166/100 |
| 8,066,074 | B2 | 11/2011 | Maskos et al. | |
| 8,347,969 | B2 | 1/2013 | Orr et al. | |
| 2004/0118563 | A1 * | 6/2004 | Bertoja | E21B 34/06 166/301 |
| 2010/0122811 | A1 | 5/2010 | Maskos et al. | |
| 2013/0032354 | A1 | 2/2013 | Gerrard et al. | |
| 2013/0062049 | A1 * | 3/2013 | Ren | B29C 44/5636 166/101 |

FOREIGN PATENT DOCUMENTS

| | | |
|---|---|---|
| EP | 1718841 | 2/2008 |
| WO | 2012054253 | 4/2012 |

* cited by examiner

*Primary Examiner* — Shane Bomar
(74) *Attorney, Agent, or Firm* — Steve Rosenblatt

(57) ABSTRACT

A pressure compensation system for enclosed spaces at a subterranean location changes volume with thermally induced solubility changes of a salt in water. The salt is held in an enclosure that is either rigid, or impervious and flexible or porous and flexible. As well conditions change and temperature increases, some of the salt goes into solution with a resulting decrease in volume that compensates for thermally induced volume increase due to temperature increase in the borehole. Conversely, a decrease in borehole temperature brings some of the salt out of solution for a volume increase to offset the volume decrease of the adjacent fluid to keep the pressure stabilized in the enclosed volume. In the porous enclosure embodiment the openings are sufficiently small to retain the salt even in solution. However, minimal net flows are anticipated for pressure compensation due to changing thermal effects.

18 Claims, 2 Drawing Sheets

CONFINED VOLUME PRESSURE COMPENSATION DUE TO THERMAL LOADING

FIELD OF THE INVENTION

The field of the invention is pressure compensation systems that operate in a confined fluid filled space in a wellbore that is subjected to varying thermal loads and more particularly systems that are variable in volume as thermal loads vary by having a material go into or come out of solution based on the surrounding temperature.

BACKGROUND OF THE INVENTION

In many types of completions there are frequently a series of packers to isolate zones of different lengths. Some of these intervals can be fairly short but in each case the fluid in the annular space between the packers is subject to thermal loads from activities in the wellbore such as production or injection and other thermal inputs such as formation temperature fluctuations. These temperature variations can expand the trapped fluid between packers and in extreme cases can adversely affect the packer function as an isolation device.

Systems have been developed to use a movable piston with an isolated chamber that is initially at atmospheric or other pressure and have the other side of the piston exposed to pressure in the confined annular space after a rupture disc breaks at a desired depth in the borehole. These systems were illustrated in a single zone between two packers or spanning adjacent zones for thermally induced pressure fluctuations. These systems are shown in U.S. Pat. No. 8,347,969. A design for a pressure compensation system involving a movable piston is also shown in U.S. Pat. No. 8,066,074 FIG. 2A.

While these systems were workable, they were also costly to build because of the large pressure differentials across the chamber walls made for fairly thick walls needed to prevent burst or collapse during normal operation. The present invention addresses the need for pressure compensation in a variety of simpler designs that operate on a different concept. That concept is to take advantage of the differing solubility of salts in water, for example, so that the volume decreases on increasing solubility on rising temperature and vice versa. The concept is applicable to designs with a floating piston as well as other embodiments where a flexible and impervious bladder is used or even an enclosure for the salt that is porous with openings small enough to retain the salt while allowing the water to migrate in or out with temperature variations to change the volume as the pressure compensation vehicle. These and other aspects of the present invention will be more readily apparent to those skilled in the art from a review of the detailed description of the preferred embodiments and the associated drawings while realizing that the full scope of the invention is to be found in the appended claims.

SUMMARY OF THE INVENTION

A pressure compensation system for enclosed spaces at a subterranean location changes volume with thermally induced solubility changes of a salt in water. The salt is held in an enclosure that is either rigid, or impervious and flexible or porous and flexible. As well conditions change and temperature increases, some of the salt goes into solution with a resulting decrease in volume that compensates for thermally induced volume increase due to temperature increase in the borehole. Conversely, a decrease in borehole temperature brings some of the salt out of solution for a volume increase to offset the volume decrease of the adjacent fluid to keep the pressure stabilized in the enclosed volume. In the porous enclosure embodiment the openings are sufficiently small to retain the salt even in solution. However, minimal net flows are anticipated for pressure compensation due to changing thermal effects.

DETAILED DESCRIPTION OF THE PREFERRED EMBODIMENT

Figure 1:
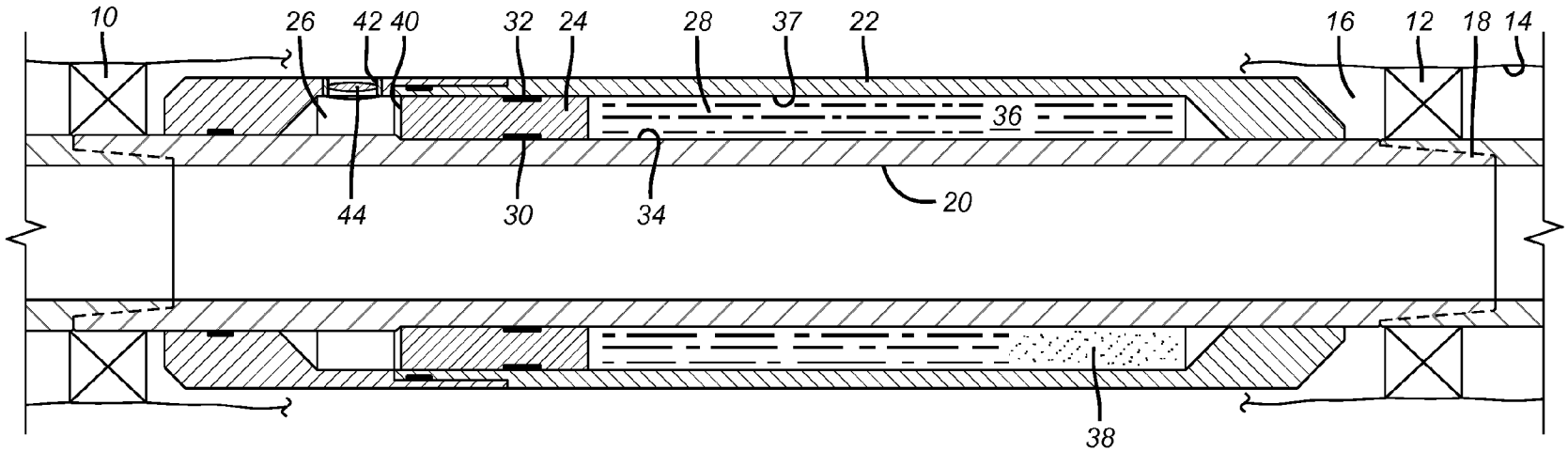
FIG. 1 is a section view of a rigid enclosure housing the material that can selectively go into solution with surrounding fluid used in conjunction with a floating piston.

FIG. 1 illustrates spaced seals such as packers 10 and 12 that are set against a borehole wall 14 that can be cased or open hole. In between the packers 10 and 12 is an enclosed annular volume 16. The packers are supported on a string 18 that has a passage 20 therethrough. An outer housing 22 surrounds the string 18 between packers 10 and 12. An annular piston 24 defines sub-chambers 26 and 28. Piston 24 has seals 30 and 32 to respectively seal against the outer surface 34 of string 18 and the inner surface 37 of outer housing 22. Preferably the volume of sub-chamber 28 is filled with fluid that is preferably a liquid such as water 36 and a crystalline form of a material such as a salt 38 that is added in amounts that exceed the capacity of the salt to go into solution with the water 36 at the maximum anticipated temperature increments that are expected in the zone 16. As the temperature in the passage 20 or in the formation increases, the water temperature increases and the crystals of the salt 38 go into solution with the water 36 such that the volume of sub-chamber 28 is reduced to offset the increase in volume of fluid in the zone 16 that communicates with the piston 24 on the opposite side 40 through port 42 once the port 42 is opened hydrostatically by breaking of the rupture disc 44. The use of the rupture disc is optional and the assembly can be run in with port or ports 42 open to side 40 of piston 24.

One unique aspect of this design is that it has minimal differential pressure across the wall of housing 22 since sub-chamber 28 is essentially liquid filled and at the same pressure as is in the zone 16. This allows for the wall of housing 22 to be relatively thin which in turn allows a larger volume for the chamber 28 without forcing a decrease in the size of the passage 20 that would otherwise impede production or injection flow. As the temperature of the water 36 increases more of the crystalline salt 38 goes into solution with the attendant volume reduction that allows the piston 24 to move to reduce the size of sub-chamber 28 and at the same time increase the volume of sub-chamber 26 to offset the volume increase of fluid in zone 16 and thus reduce or eliminate pressure increase in zone 16 from thermal expansion of the fluid in the zone.

In injection wells where the system is more or less installed at undisturbed temperature, and especially in the worst case subsea injection wells where injection fluid is pumped through pipe lines along the bottom of the ocean to the well head then injected, the temperature can be as cool as 34 F. In this application the cooling can reduce the trapped volume to the extent that the outer casing may collapse or the internal casing yield with applied injection pressure.

Figure 2:
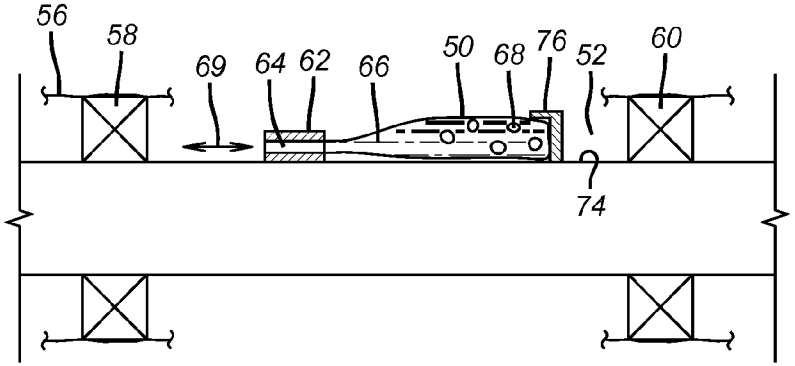
FIG. 2 is a schematic illustration of a flexible enclosure containing the material that will go into solution on a rise in temperature.
Figure 3:
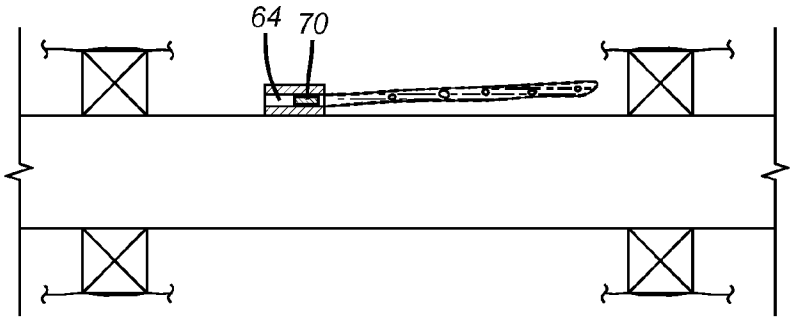
FIG. 3 is the view of FIG. 2 showing the volume decrease on rising temperature.

FIGS. 2 and 3 illustrate another embodiment where an impervious flexible container 50 is in a zone 52 defined by mandrel or string 74, the borehole wall 56 and annular seals 58 and 60. A support 62 has a passage 64 that communicates at one end to the zone 52 and at the other end to the interior of the flexible container 50. Inside the container is preferably water 66 and an excess of a crystalline salt 68. A barrier or floating piston can optionally be inserted in passage 64 to retain the water 66 and salt 68 in the container 50. Double headed arrow 69 indicates the fluid movement possible in opposed directions as the surrounding temperature is increased and decreased. On temperature increase, more of the salt 68 goes into solution with the water 66 to reduce the aggregate volume of the container 50 which in turn allows the fluid outside the container 50 and in zone 52 the ability to respond to thermal loading and expand in volume. FIG. 3 shows in an exaggerated manner this action when the temperature increase to reduce the volume of container 50 and consequently increase the volume of the zone 52 that surrounds it. FIG. 3 illustrates the placement of optional floating piston 70 in passage 64 as discussed above. If the conditions reverse and the temperature decreases, then salt drops out of solution to increase volume in the flexible impervious container 50 so that its volume grows to compensate for the volume reduction of the surrounding fluid in zone 52.

Figure 4:
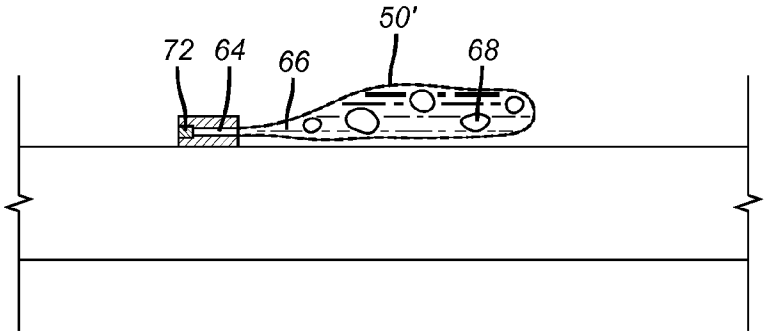
FIG. 4 shows a flexible porous membrane that retains the material at a time before the temperature rises.
Figure 5:
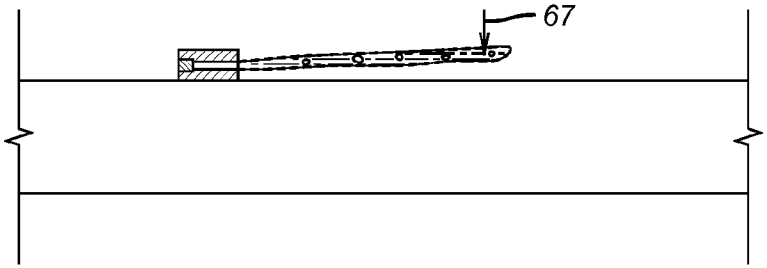
FIG. 5 is the view of FIG. 4 showing a volume reduction on rising temperature as some of the material goes in solution with the material in the flexible porous membrane.

FIGS. 4 and 5 are similar to FIGS. 2 and 4 except that the passage 64 is closed with a plug 72 or the passage 64 can be eliminated as an alternative. The container 50' is a fine membrane that can let a fluid like the water 66 pass in opposed directions 67 on temperature variations while retaining the salt 68 whether in crystalline form or in solution with the water. The operation is the same as in FIGS. 2 and 3 but the flow of water in opposed directions to put more or less of the salt 68 in solution is through the membrane that is the container 50' in this embodiment.

Those skilled in the art will appreciate that other combinations of fluid and chemical that goes into and out of solution with varying temperature are contemplated although water soluble salts are preferred. Some of the contemplated salts include but are not limited to Sodium Chloride, Calcium Chloride, Sodium Formate, Potassium Formate. Various fasteners can be used to retain the flexible containers 50 and 50' to adjacent mandrels such as 74 and are schematically illustrated as 76. This is to keep the profile small for running in and avoid damage during running in. In the FIG. 1 embodiment there can be some gas in the sub-chamber 28 and the piston 24 can be initially restrained such as with a shear device. It is preferred to run in the FIG. 1 assembly without the rupture disc to let the pressures equalize on opposed sides of the piston 24 until the desired location is reached. Because the differential pressures on the outer wall of the housing 22 are small more volume can be displaced by the same axial motion of the piston 24. The housing is also cheaper to produce and generation of high pressure compressed gas is for the most part avoided.

The above description is illustrative of the preferred embodiment and many modifications may be made by those skilled in the art without departing from the invention whose scope is to be determined from the literal and equivalent scope of the claims below:

We claim:

1. A pressure compensation assembly for a fluid in a confined annular space defined about a tubular string at a subterranean location that is subject to temperature fluctuation, comprising:

a container mounted in the annular space and in direct or indirect communication with said fluid;

a solid material in said container with a liquid such that at least some of said solid material goes into solution with said liquid on rising fluid temperature and comes out of solution from said liquid on falling fluid temperature to compensate for temperature induced volume changes in said fluid by inversely changing a volume of said container.

2. The assembly of claim 1, wherein:
said material is a salt and said liquid is water.

3. The assembly of claim 1, wherein:
said container has a flexible wall.

4. The assembly of claim 1, wherein:
said container has a porous wall.

5. The assembly of claim 4, wherein:
said porous wall allows said liquid to pass therethrough in opposed directions while retaining said solid material regardless of its state as a stand-alone material or whether said material is in solution.

6. The assembly of claim 1, wherein:
said container has a rigid wall defining a volume that varies with movement of a floating piston.

7. The assembly of claim 6, wherein:
said floating piston comprises at least one seal to isolate said liquid from said fluid.

8. The assembly of claim 6, wherein:
said floating piston is initially restrained for running in.

9. The assembly of claim 1, wherein:
said container has an annular shape and is supported by the string.

10. The assembly of claim 1, further comprising:
spaced packers supported by said string to define said confined annular space.

11. The assembly of claim 1, wherein:
said container has a flexible wall.

12. The assembly of claim 11, wherein:
said container has a porous wall.

13. The assembly of claim 12, wherein:
said porous wall allows said liquid to pass therethrough in opposed directions while retaining said solid material regardless of its state as a stand-alone material or whether said material is in solution.

14. The assembly of claim 13, wherein:
said container has an annular shape and is supported by the string.

15. The assembly of claim 14, further comprising:
spaced packers supported by said string to define said confined annular space.

16. The assembly of claim 2, wherein:
said container has a rigid wall defining a volume that varies with movement of a floating piston.

17. The assembly of claim 16, wherein:
said floating piston comprises at least one seal to isolate said liquid from said fluid.

18. The assembly of claim 17, wherein:
said floating piston is initially restrained for running in.

* * * * *